United States Patent [19]

Koinuma

[11] Patent Number: 4,745,885

[45] Date of Patent: May 24, 1988

[54] COOLANT PASSAGE SYSTEM FOR V-SHAPED INTERNAL COMBUSTION ENGINE

[75] Inventor: Yutaka Koinuma, Tokyo, Japan

[73] Assignee: Honda Giken Kogyo Kabushiki Kaisha, Tokyo, Japan

[21] Appl. No.: 919,087

[22] Filed: Oct. 15, 1986

[30] Foreign Application Priority Data

Oct. 16, 1985 [JP] Japan ..... 60-228926

[51] Int. Cl.[4] ..... F01P 7/02

[52] U.S. Cl. ..... 123/41.05; 123/41.08; 123/41.44; 123/41.46

[58] Field of Search ..... 123/41.08, 41.09, 41.1, 123/41.44, 41.46, 41.47; 236/34.5

[56] References Cited

U.S. PATENT DOCUMENTS

| | | | |
|---|---|---|---|
| 2,161,942 | 6/1939 | Zoerlein | 123/41.08 |
| 2,713,332 | 7/1955 | Beardsley | 123/41.44 |
| 2,807,245 | 9/1957 | Unger | 123/41.1 |
| 4,133,284 | 1/1979 | Holcroft | 123/41.08 |
| 4,300,718 | 11/1981 | Beyer | 123/41.09 |
| 4,621,594 | 11/1986 | Kubis | 123/41.09 |

*Primary Examiner*—E. Rollins Cross

*Attorney, Agent, or Firm*—Lyon & Lyon

[57] ABSTRACT

A coolant passage system in a V-shaped internal combustion engine includes a coolant pump disposed on one side of the engine in the direction of the crankshaft at the V-shaped space between the cylinder banks for delivering a coolant into coolant jackets defined respectively in the cylinder banks, the coolant pump having an inlet opening toward the V-shaped space. A collecting conduit is disposed on an opposite side of the engine at the V-shaped space for delivering the coolant from the coolant jackets to a radiator. A valve casing housing a thermovalve therein for delivering the coolant from said radiator is integrally formed with the collecting conduit and has an outlet opening toward the V-shaped space. The inlet of the coolant pump and the outlet of the collecting conduit are interconnected by a connecting pipe disposed in the V-shaped space.

11 Claims, 7 Drawing Sheets

COOLANT PASSAGE SYSTEM FOR V-SHAPED INTERNAL COMBUSTION ENGINE

The present invention relates to an internal combustion engine, and more particularly to a coolant passage system for use in a V-shaped internal combustion engine.

One known coolant passage system for use in a V-shaped internal combustion engine comprises a coolant pump for delivering the coolant into coolant jackets defined respectively in a pair of cylinder banks of the engine, and a collecting conduit for supplying the coolant from the coolant jackets to a radiator, as disclosed in Japanese Laid-Open Patent Publication No. 58(1983)-107840. In that system the coolant pump and the conduit are disposed on one side of the cylinder banks in the direction of the crankshaft. However, with the coolant pump and the conduit being thus positioned on one side of the banks, that side of the bank is crowded with components, which cannot easily be serviced.

U.S. Pat. No. 2,807,245 to Unger also discloses a conventional cooling system for an engine wherein the coolant is used for heating the intake manifold.

SUMMARY OF THE INVENTION

It is an object of the present invention to provide a unique coolant passage system which is relatively simple and compact.

Another object of the present invention is to provide a unique coolant passage system which is composed of a reduced number of components.

According to the present invention, there is provided a coolant passage system in a V-shaped internal combustion engine having a crankshaft, a radiator, and a pair of cylinder banks having respective coolant jackets defined therein, with a V-shaped space defined between the cylinder banks. The coolant passage system includes a coolant pump disposed at one side of the engine in the direction of the crankshaft and at the V-shaped space for delivering a coolant into the coolant jackets, the coolant pump having an inlet opening toward the V-shaped space, a collecting conduit disposed at the opposite side of the engine at the V-shaped space for delivering the coolant from the coolant jackets to the radiator, a valve casing housing a thermostatic valve for delivering the coolant from the radiator, the valve casing being integrally formed with the collecting conduit and having an outlet opening toward the V-shaped space, and a connecting pipe interconnecting the inlet and the outlet and disposed in the V-shaped space.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
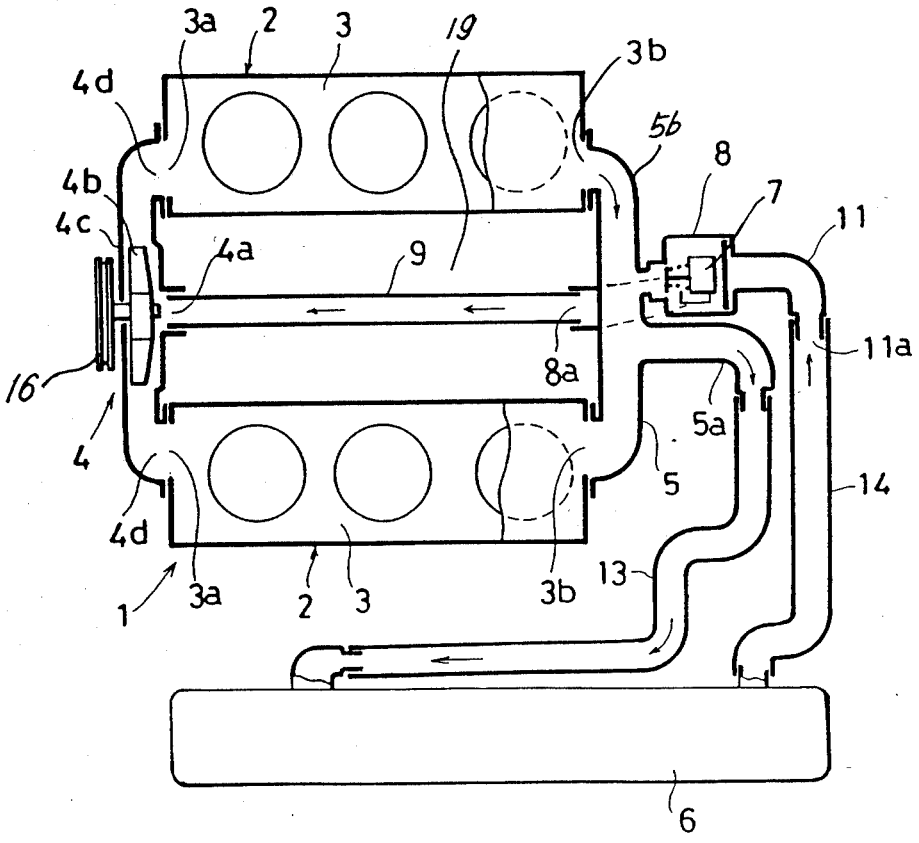
FIG. 1 is a schematic plan view of a V-shaped internal combustion engine incorporating the coolant passage system according to the present invention.

As shown in FIG. 1, a V-shaped internal combustion engine for use in an automobile and designed to be mounted transversely of the automobile includes a pair of front and rear cylinder banks 2 inclined to each other in the form of a V, each of the cylinder banks 2 having a coolant jacket 3 defined therein. An engine coolant is supplied by a common coolant pump 4 into the coolant jackets 3 of both banks through respective inlets 3*a*. The engine coolant which has been heated in the coolant jackets 3 is then delivered from the coolant jackets 3 through respective outlets 3*b* into a collecting conduit 5 connected thereto, and then supplied from the collecting conduit 5 into a radiator 6 disposed in front of the engine 1. The engine coolant that has been cooled by the radiator 6 is delivered from the radiator 6 through a thermostatical controlled valve or thermovalve 7, which is positioned downstream of the radiator 6, into the coolant pump 4 via its inlet 4*a* which opens toward the V-shaped space 19 between the cylinder banks 2. The engine coolant is therefore forcibly circulated by the coolant pump 4 through the engine coolant passage system.

The coolant pump 4 is disposed on one side of the engine 1 in the direction of a crankshaft 18 (FIG. 3), while the collecting conduit 5 is disposed on the opposite side of the engine 1. The thermovalve 7 is housed in a valve casing 8 integrally formed with the collecting conduit 5. The valve casing 8 has an outlet 8*a* opening toward the V-shaped space 19 and connected to the inlet 4*a* of the coolant pump 4 through a connecting pipe 9 disposed in the V-shaped space 19 and extending parallel to the cylinder banks 2.

Figure 2:
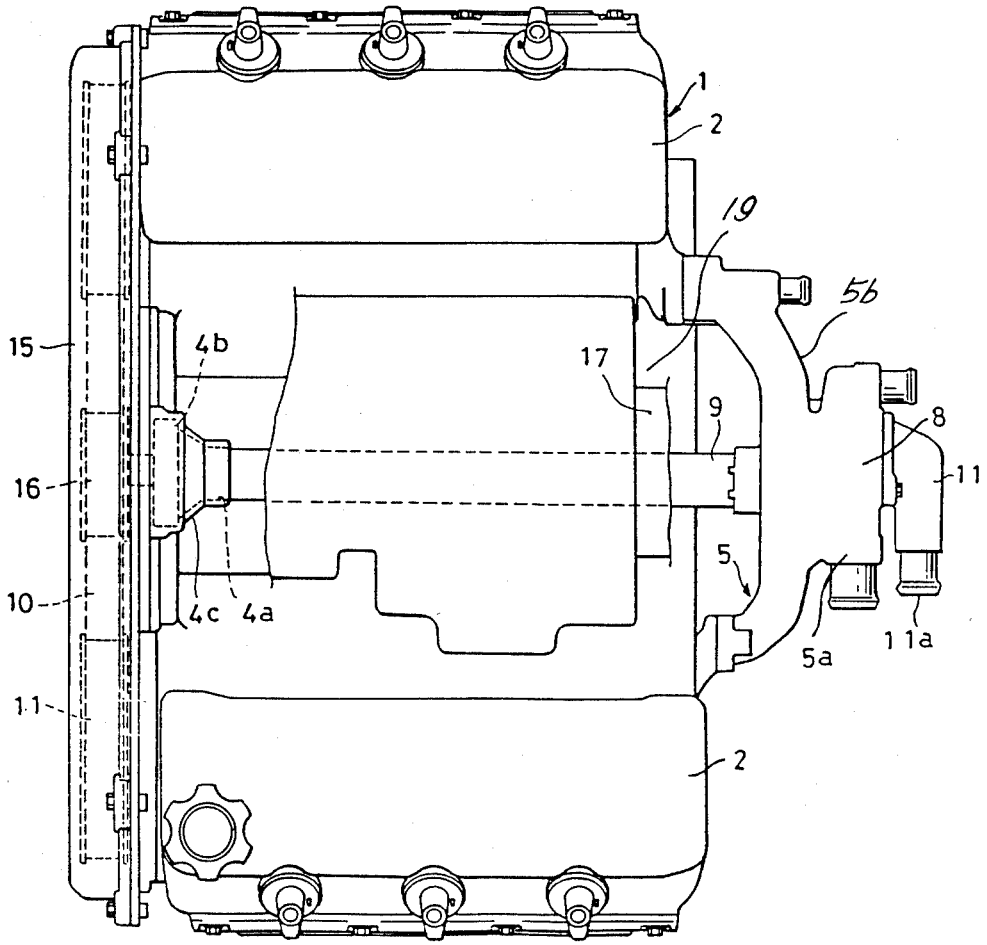
FIG. 2 is a plan view of the engine.
Figure 3:
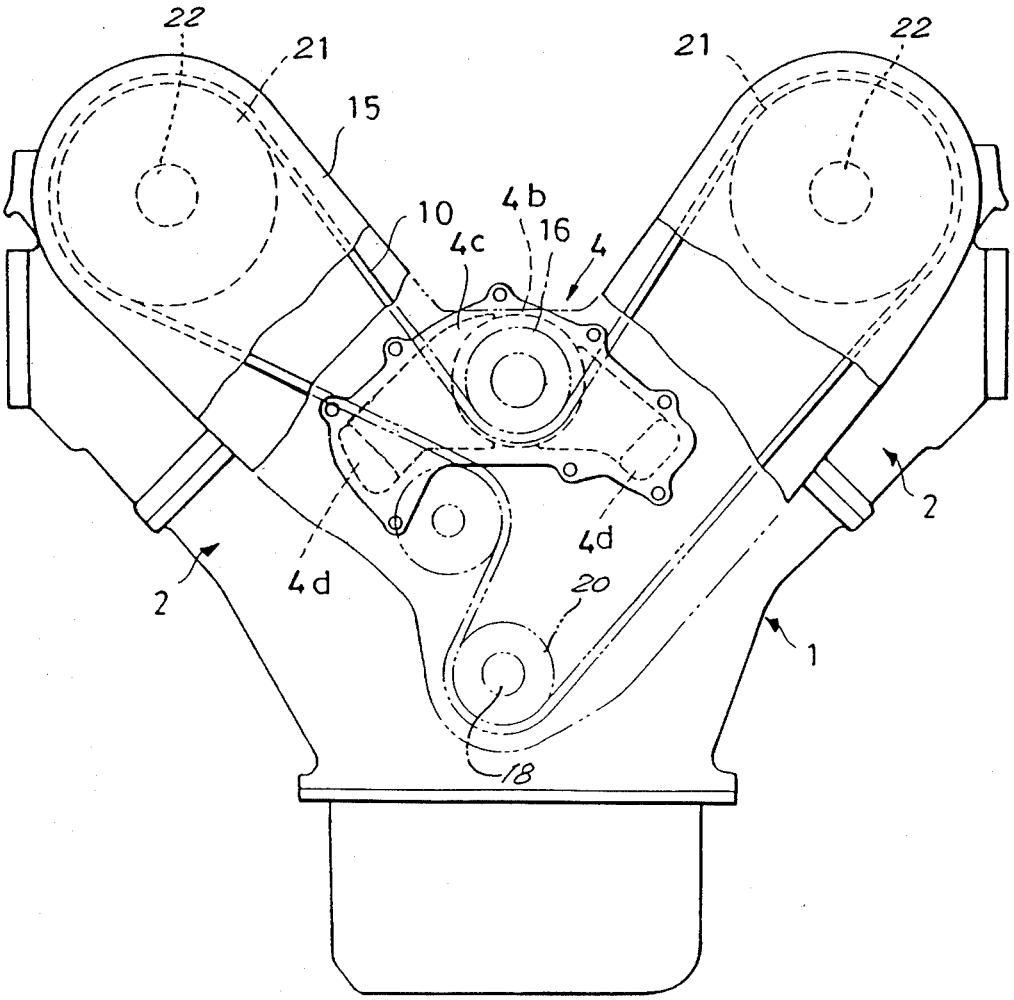
FIG. 3 is a left-hand side elevational view, partly broken away, of the engine.

As illustrated in FIGS. 1 through 3, the coolant pump 4 is in the form of a centrifugal pump having a pump casing 4*c* in which an impeller 4*b* is rotatably housed. The pump casing 4*c* has a pair of outlets 4*d* defined in opposite ends thereof which communicate with the inlets 3*a*, respectively, of the coolant jackets 3. The inlet 4*a* of the coolant pump 4 is located centrally in a side of the pump casing 4*c*.

The coolant pump 4 is positioned on one side of the cylinder banks 2 where a timing belt 10 is located, i.e., on the left-hand side of FIG. 2, whereas the collecting conduit 5 is disposed on the opposite side of the cylinder banks 2 where a transmission case (not shown) is located i.,e, on the right-hand side of FIG. 2. The connecting pipe 9 lying in the V-shaped space 19 has one end fitted in the inlet 4*a* and the opposite end fitted in the outlet 8*a*.

Figure 4:
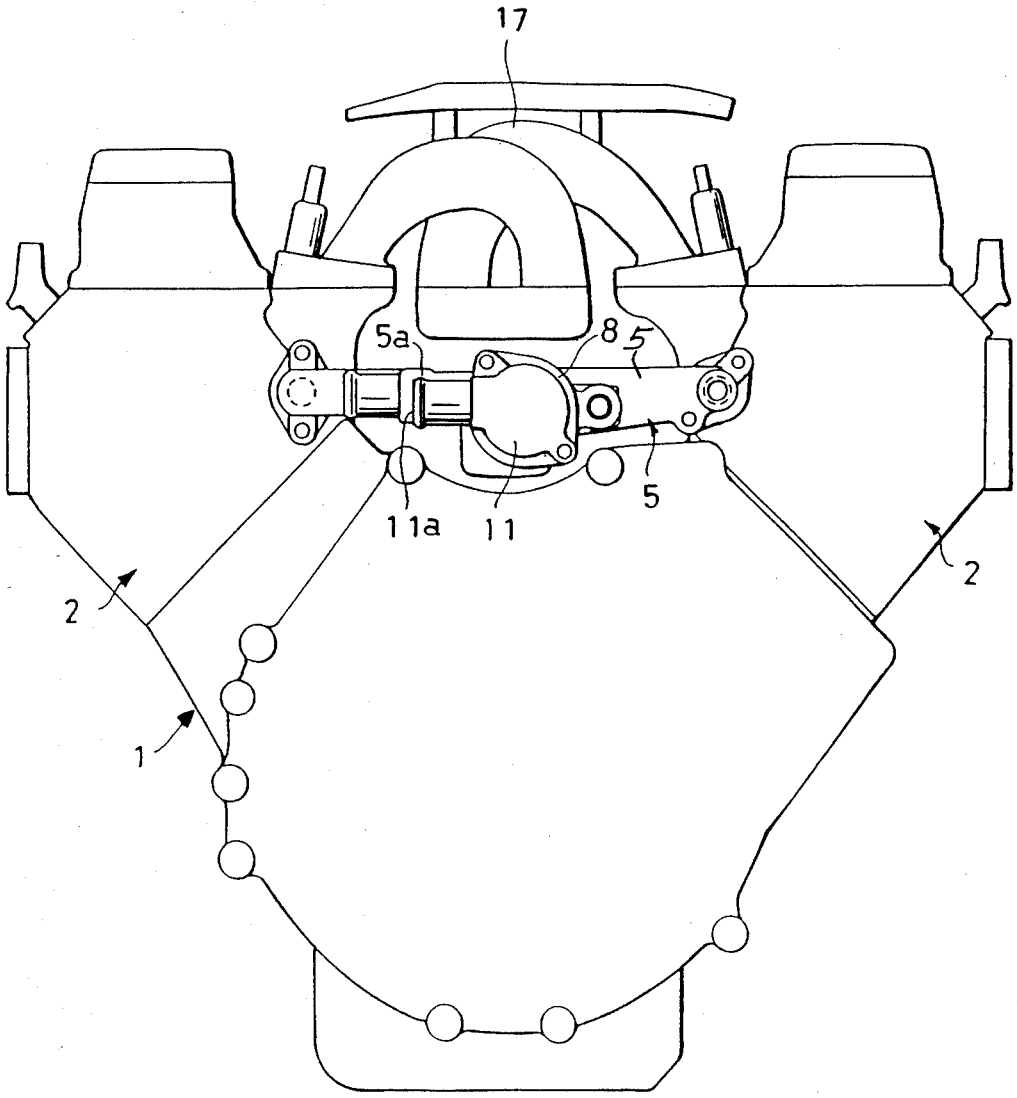
FIG. 4 is a right-hand side elevational view of the engine.
Figure 5:
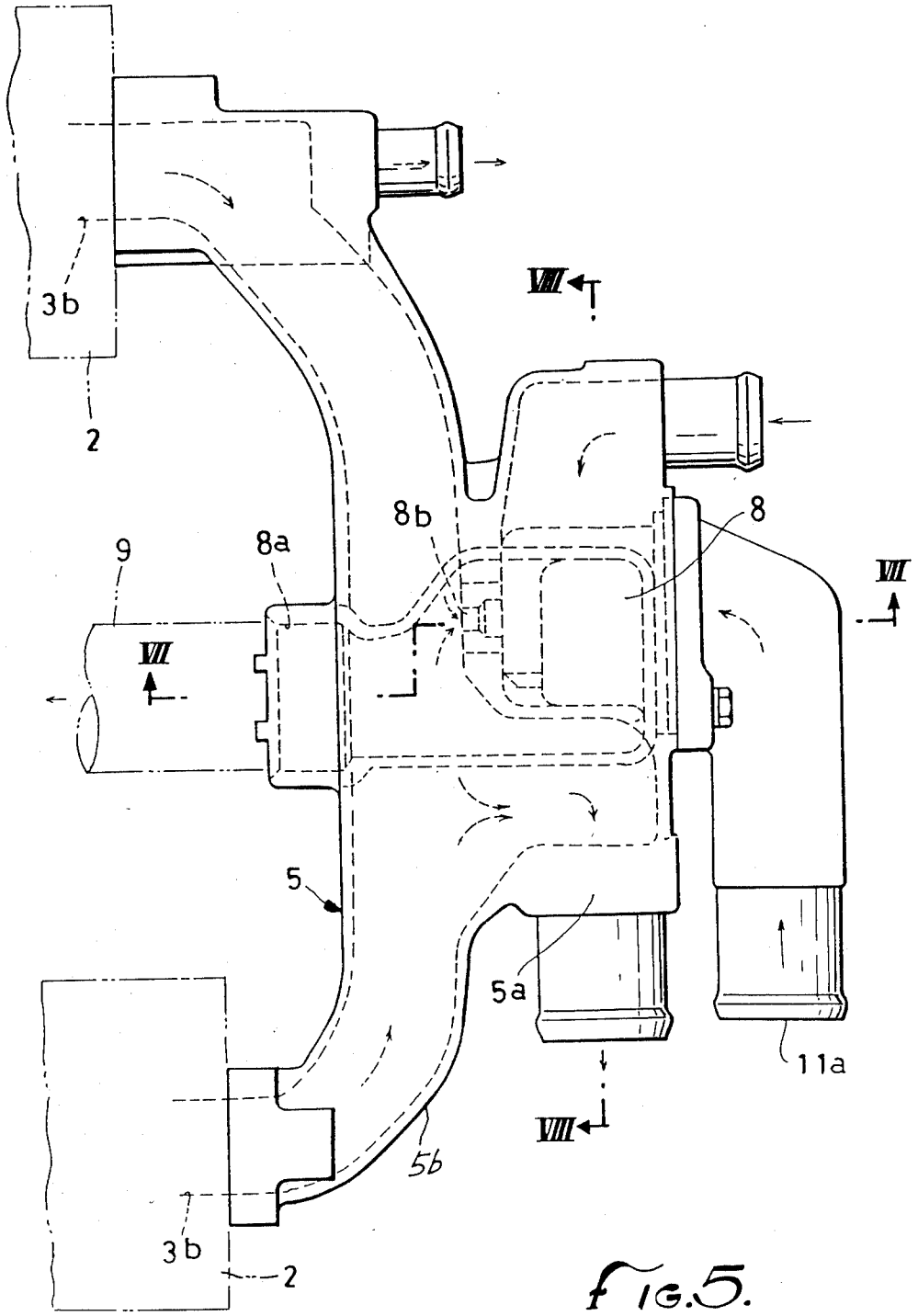
FIG. 5 is an enlarged plan view of a collecting conduit of the coolant passage system.
Figure 6:
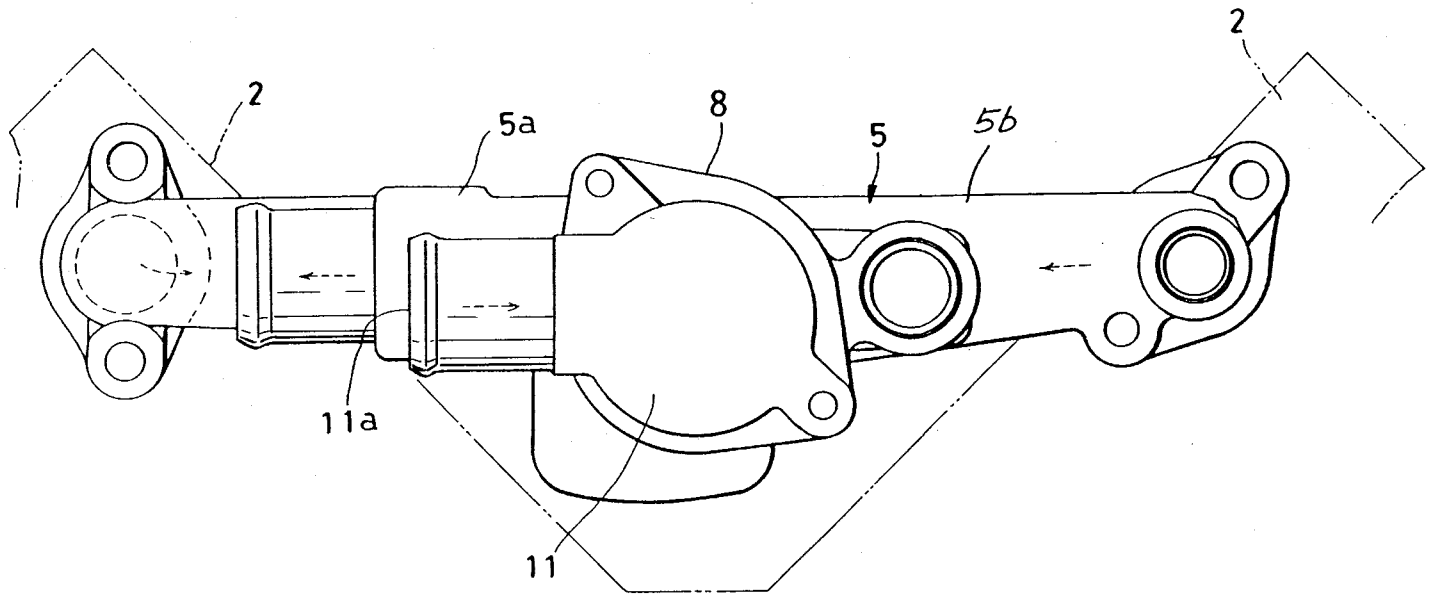
FIG. 6 is a right-hand side elevational view of the collecting conduit shown in FIG. 5.

As shown in FIGS. 4 through 6, the collecting conduit 5 has an outlet 5*a* extending laterally outwardly from a coolant passage portion 5*b* which extends between the cylinder banks 2 and interconnects the outlets 3*b*. The outlet 5*a* opens forwardly toward the radiator. The valve casing 8 is disposed adjacent to the outlet 5*a* and has an open lateral outer end for receiving the coolant from the radiator 6. The outlet 8*a* of the casing 8 extends laterally inwardly from a lower side of the casing 8 beneath the coolant passage portion 5*b* into communication with the connecting pipe 9.

Figure 7:
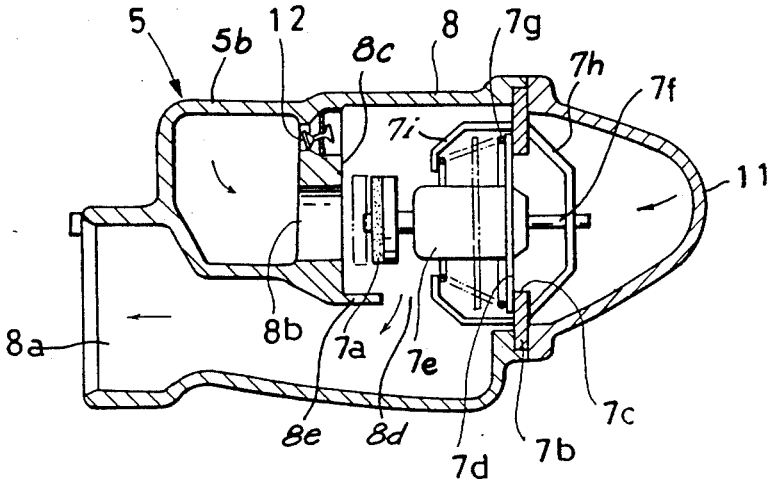
FIG. 7 is a cross-sectional view taken along line VII—VII of FIG. 5.
Figure 8:
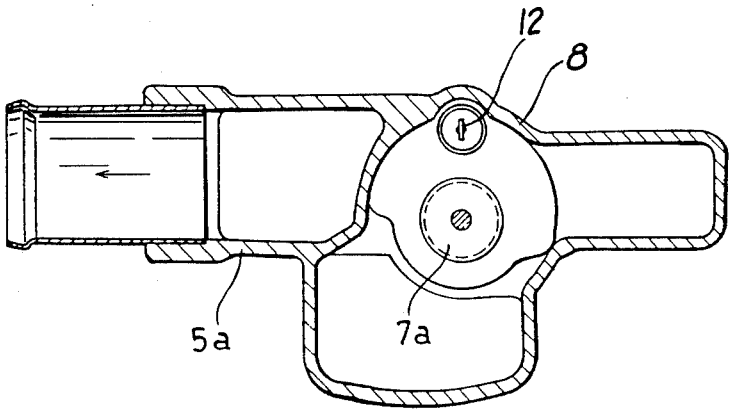
FIG. 8 is a cross-sectional view taken along line VIII—VIII of FIG. 5.

The thermovalve 7 is housed horizontally in the valve casing 8. As shown in FIGS. 7 and 8, the thermovalve 7 comprises a first valve body 7*a* movably positioned in confronting relation to a bypass port 8*b* defined in a side wall 8*c* positioned between the coolant passage portion 5*b* and the valve casing 8, a second valve body 7*d* movably positioned in confronting relation to an inlet port 7*c* defined in a valve seat 7*b* fitted in the valve casing 8, the inlet port 7*c* communicating with the radiator 6, and a temperature sensor 7*e* on which the first and second valve bodies 7*a*, 7*d* are mounted. The temperature sensor 7*e* is horizontally disposed in the valve casing 8 and supported on the valve seat 7*b* by a piston rod 7*f* having one end inserted in the temperature sensor 7*e* and an opposite end attached to a bracket 7*h* fixed to the valve seat 7*b*. The valve seat 7*b* is retained in position on the valve casing 8 by a cap 11 attached to the valve casing 8 and having a connecting port 11*a* communicating with the radiator 6. The valve casing 8 has an outlet port 8*d* defined in a lower side wall 8*e* of the valve casing 8 and communicating with the oulet 8*a*, which extends inwardly from the outlet port 8*d*.

The second valve body 7*d* is normally urged in a direction to close the inlet port 7*c* by a spring 7*g* disposed around the temperature sensor 7*e* and acting between the second valve body 7*d* and a bracket 7*i* attached to the valve seat 7*b* remotely from the bracket 7*h*. The thermovalve 7 functions in a conventional manner. During engine warm-up or any other condition when the coolant is at a low temperature, the valve body 7*d* closes inlet port 7*c* to prevent coolant from being drawn from the radiator 6 and the valve body 7*a* is open to cause the coolant to be recirculated through the engine. When the coolant is at or above a selected temperature, the valve body 7*a* closes and the valve body 7*d* opens to allow coolant to be drawn from the radiator. A valve 12 known as a jiggle pin is mounted in the side wall 8*c* for bleeding air out of the valve casing 8.

As shown in FIG. 1, the outlet 5*a* of the collecting conduit 5 is connected by a hose 13 to the radiator 6. The connecting port 11*a* of the cap 11 is connected by a hose 14 to the radiator 6.

As shown in FIGS. 2 and 3, the timing belt 10 is covered by a belt cover 15, as shown in FIGS. 2 and 3. The timing belt 10 is trained around a pulley 20 mounted on the crankshaft 18, a pair of pulleys 21 mounted on camshafts 22 rotatably supported by the cylinder banks 2, respectively, and a pulley 16 coupled to the coolant pump 4*b*. As shown in FIGS. 2 and 4, an intake manifold 17 is positioned in the V-shaped space 19 and above the connecting pipe 9.

Operation of the coolant passage system as thus constructed is as follows: When the coolant pump 4 is operated, the coolant is delivered from the inlets 3*a* into the coolant jackets 3. The coolant as it is heated is delivered from the coolant jackets 3 into the collecting conduit 5, from which the coolant is fed through the outlet 5*a* and the hose 13 into the radiator 6, in which the coolant is cooled. Then, the coolant is fed through the hose 14, the thermovalve 7 in the valve casing 8, the outlet 8*a*, and the connecting pipe 9 into the inlet 4*a* of the coolant pump 4. The coolant is therefore forcibly circulated through the coolant passage system by the coolant pump 4.

The outlet 8*a* of the valve casing 8 extends across and beneath the collecting conduit 5 for supplying the coolant from the radiator 6 to the connecting pipe 9 coupled to the inlet 4*a* of the coolant pump 4. The valve casing 8 that houses the thermovalve 7 is integrally formed with the collecting conduit 5, with the outlet 8*a* opening toward the V-shaped space 19. This tubing arrangement is relatively compact and small in size. Since the coolant pump 4 is disposed on one side of the cylinder banks 2 and the collecting conduit 5 is on the other side, with the connecting pipe 9 between the coolant pump 4 and the collecting conduit 5 being disposed in the V-shaped space 19, neither side of the cylinder banks 2 is crowded with components. As a result, the entire coolant passage system is relatively simple and compact, and can easily be serviced. Inasmuch as the valve casing 8 is integral with the collecting conduit 5, the number of components required is reduced, and also the number of parts to be sealed is small.

Although a certain preferred embodiment has been shown and described, it should be understood that many changes and modifications may be made therein without departing from the scope of the appended claims.

What is claimed:

1. A coolant passage system in a V-shaped internal combustion engine having a crankshaft, a radiator, and a pair of cylinder banks having respective coolant jackets defined therein, with a V-shaped space defined between said cylinder banks, comprising:

a coolant pump disposed on one side of said cylinder banks in the direction of said crankshaft for delivering a coolant into said coolant jackets, said coolant pump having an inlet opening toward said V-shaped space;

a collecting conduit disposed on an opposite side of said cylinder banks for delivering the coolant from said coolant jackets to said radiator;

a valve casing housing a thermovalve for delivering the coolant from said radiator, said valve casing being integrally formed with said collecting conduit and having an outlet opening toward said V-shaped space; and a connecting pipe interconnecting said inlet and said outlet and disposed in said V-shaped space.

2. A coolant passage system according to claim 1, wherein said coolant pump comprises a pump casing and an impeller rotatably disposed in said pump casing, said pump casing having a pair of outlets communicating with said coolant jackets, respectively.

3. A coolant passage system according to claim 2, wherein said outlets of said pump casing are defined respectively at opposite ends thereof, said inlet of said pump casing being positioned between said outlets.

4. A coolant passage system according to claim 1, wherein said collecting conduit has a coolant passage portion extending between said cylinder banks and communicating with said coolant jackets, and an outlet extending from said coolant passage portion and communicating with said radiator, said outlet of said valve casing extending across said coolant passage portion.

5. A coolant passage system according to claim 1, wherein said connecting pipe extends parallel to said cylinder banks and has opposite ends fitted in said inlet and said outlet, respectively.

6. A coolant passage system according to claim 1, wherein said collecting conduit has an outlet for delivering the coolant to said radiator, said thermovalve being housed substantially horizontally in said valve casing, said valve casing being disposed adjacent to said outlet of said collecting conduit and having an open outer end for receiving the coolant from said radiator, said valve casing having a bypass port defined in a side wall between said valve casing and said collecting conduit, and an outlet port defined in a lower side wall of said valve casing, said outlet of the valve casing extending inwardly from said outlet port beneath said collecting conduit into communication with said connecting pipe.

7. A coolant passage system according to claim 6 wherein said thermovalve has means for opening said bypass port during low coolant temperature conditions and closing said bypass port during high coolant temperature conditions.

8. A coolant passage system in a V-shaped internal combustion engine having a crankshaft, a radiator, and a pair of cylinder banks having respective coolant jackets defined therein, comprising:

a collecting conduit disposed on one side of said cylinder banks in the direction of the crankshaft and having an outlet for delivering the coolant from said coolant jackets to said radiator;

a valve casing housing a thermovalve substantially horizontally therein for delivering the coolant from said radiator, said valve casing being integrally formed with said collecting conduit adjacent to said outlet of said collecting conduit and having an open outer end for receiving the coolant from said radiator, said valve casing having a bypass port defined in side wall between said valve casing and said collecting conduit, an outlet port defined in a lower side wall of said valve casing, and an outlet extending inwardly from said outlet port beneath said collecting conduit; and a single coolant pump disposed on an opposite side of said cylinder banks from the collecting conduit in the direction of the crankshaft for effecting circulation of the coolant in the said coolant passage system.

9. A coolant passage system according to claim 8 wherein a thermovalve is provided and has means for opening said bypass port during low coolant temperature conditions and closing said bypass port during high coolant temperature conditions.

10. A coolant passage system in a V-shaped internal combustion engine having a crankshaft, a radiator, and a pair of cylinder banks having respective coolant jackets defined therein, comprising:

a collecting conduit disposed on one side of said cylinder banks in the direction of the crankshaft and having an outlet for delivering the coolant from said coolant jackets to said radiator;

a valve casing housing a thermovalve substantially horizontally therein for delivering the coolant from said radiator, said valve casing being integrally formed with said collecting conduit adjacent to said outlet of said collecting conduit and having an open outer end for receiving the coolant from said radiator, said valve casing having a bypass port defined in a side wall between said valve casing and said collecting conduit, an outlet port defined in a lower side wall of said valve casing, and an outlet extending inwardly from said outlet port beneath said collecting conduit; and a coolant pump disposed on an opposite side of said cylinder banks in the direction of the crankshaft, and means extending along and between said cylinder banks connects said coolant pump to said outlet from the valve casing.

11. A coolant passage system according to claim 10 wherein a thermovalve is provided and has means for opening said bypass port; during low coolant temperature conditions and closing said bypass port during high coolant temperature conditions.

* * * * *